US006158910A

United States Patent [19]

Jolly et al.

[11] Patent Number: 6,158,910

[45] Date of Patent: Dec. 12, 2000

[54] MAGNETORHEOLOGICAL GRIP FOR HANDHELD IMPLEMENTS

[75] Inventors: Mark R. Jolly, Raleigh; Scott R. Bryan, Pittsboro, both of N.C.

[73] Assignee: Lord Corporation, Cary, N.C.

[21] Appl. No.: 09/385,723

[22] Filed: Aug. 30, 1999

[51] Int. Cl.[7] ..... A46B 5/02

[52] U.S. Cl. ..... 401/6; 16/DIG. 12; 16/430

[58] Field of Search ..... 401/6, 209, 421; 16/430, 110, DIG. 12

[56] References Cited

U.S. PATENT DOCUMENTS

| | | | |
|---|---|---|---|
| 5,143,463 | 9/1992 | Pozil et al. | 401/6 |
| 5,558,452 | 9/1996 | Oka et al. | 401/6 |
| 5,816,372 | 10/1998 | Carlson et al. | 188/267.2 |
| 5,970,581 | 10/1999 | Chadwick et al. . | |

*Primary Examiner*—David J. Walczak
*Attorney, Agent, or Firm*—Wayne W. Rupert; Michael M. Gnibus

[57] ABSTRACT

A deformable grip (10) for handheld implements such as writing pen (20) and other handheld equipment such as shaving instruments, medical instruments, sporting equipment, and similar articles, which is capable of being deformed in conformance with the user's s hands and fingers. The present grip (10) includes an elastomeric sleeve (40) filled with a magnetorheological (MR) fluid (60) and a magnetic field generator that acts upon such fluid to adjust grip deformability. In a preferred form of the invention, the implement body (32) or other equipment handle is configured to include a recessed cavity (35) wherein the (MR) fluid-filled sleeve (40) resides. A permanent magnet assembly (34) is disposed within the tubular sleeve (40) such that in an on-state of the present grip (10), the magnetic flux field extends radially to pass through the (MR) fluid (60) to instantaneously solidify it in a relatively nondeformable set condition in conformance with the user's anatomical contours. In an off-state of the grip (10), the magnetic flux field is diverted from the (MR) fluid (60), which reverts back to a soft, deformable condition. The deformability of the grip (10) is controlled by a sliding mechanical mechanism within the pen (20). In an alternative embodiment the deformabilty of the grip (10) is controlled by an electromagnet (65) electrically interconnected to a miniature battery (66), a switch (67), and a varistor (68) which permits adjustment of the voltage applied to the electromagnet (65).

22 Claims, 4 Drawing Sheets

MAGNETORHEOLOGICAL GRIP FOR HANDHELD IMPLEMENTS

FIELD OF INVENTION

The present invention relates generally to deformable grips for handheld implements such as pens, mechanical pencils, and other handheld equipment and, more particularly to a deformable grip containing a magnetorheological fluid and a magnetic field generator, which acts upon such fluid to adjust grip deformability.

BACKGROUND OF INVENTION

It is widely recognized that the size and shape of many handheld instruments including writing implements such as pens, pencils, and other similar tools are not designed for prolonged use without producing a relatively high degree of user fatigue and discomfort. In an effort to resolve this problem, numerous writing implements have been developed which feature contoured grip surfaces of various sizes and ergonomic designs.

Some such contoured grip surfaces include complex molded surfaces designed to approximate the anatomical contours of a user's fingers and thumb while grasping the writing implement or other tool. However, such grip surface configurations have met with only limited success in relieving user fatigue because the molded grip surface is unable to take into account the anatomical shapes of different users and the many individual techniques of grasping a writing implement or similar tool.

Other writing implements have been designed with resilient grip surfaces in an alternative approach to obtaining comfort and reducing fatigue during use. Such resilient grip surfaces typically feature a sleeve-like structure disposed about the body portion of a writing implement to provide a cushioned grip surface that yields to some extent to fingertip pressure whenever the writing implement is gripped by the user. While achieving some improvement in user comfort, the sleeve is incapable of undergoing and retaining a substantial change in shape and cannot accommodate a customized fit tailored to the individual user. Further, the resilient nature of such a sleeve causes it to immediately spring back toward the nondeformed state.

Still other writing implements have been developed in which the writing implement body is provided with an annular cavity enclosed by a resilient sleeve with a deformable putty material carried within the cavity. For example, U.S. Pat. No. 5,000,599 ('599 patent) discloses such a writing implement. Upon fingertip grasping during use of the writing implement, the resilient sleeve is pressed against the deformable putty to reshape the deformable grip in accordance with custom fit anatomical contours. The putty material has a relatively high degree of elasticity yet relatively slow recovery time or speed of retraction upon deformation, such that the deformable grip will retain its deformed configuration after release for at least five seconds or more. However, after that time period the deformable grip will slowly return substantially to its initial nondeformed state.

In accordance with alternative further aspects of the ('599 patent), the deformable putty material within the recessed cavity may be provided, for example, from a curable substance to permit initial deformation from a generally cylindrical shape to a custom fit shape, followed by material curing to a relatively nondeformable set. In this version the cured material will maintain indefinitely the unique shape characteristics for a specific individual user.

In another alternative embodiment disclosed in the ('599) patent, the deformable grip may be defined by a generally cylindrical extrusion having resilient outer and inner concentric sleeve components interconnected by a plurality of radially-oriented, vented webs defining a plurality of chambers in communication with each other. These chambers contain a flowable yet relatively viscous substance, which displaces through vent openings in the webs to permit the overall extrusion to assume different geometries in response to fingertip pressure applied by the user. The deformed geometry is retained for a short time after release of the grip due to the vent openings permitting only a relatively slow material return to equilibrium condition within the chambers.

However, there is a need for further improvement in deformable grips for writing implements and other handheld tools and equipment, particularly with respect to an improved deformable grip, which selectively provides custom fit anatomical contours to the user in a relatively nondeformable set condition for any desired time of use. After such period of use, the customized grip may be retained by the user or released to its initial deformable condition. After being released to its deformable state, the present grip may be regripped by the same or a second user to an alternative relatively nondeformable set condition for a further indefinite time period. The present invention fulfills these needs and provides further related advantages as described hereinafter in further detail. The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

Accordingly, the present invention is a deformable grip for handheld implements such as mechanical pens and pencils, and other equipment such as hand tools, shaving instruments, medical instruments, sporting equipment (i.e. tennis rackets, golf clubs, fishing rods, baseball bats, etc.) capable of being deformed in conformance with the user's fingers and hands. The present grip assumes a custom fit configuration when gripped by a user providing enhanced comfort and reduced fatigue during use.

Advantageously, the custom fit configuration may be selectively retained in a relatively nondeformable set condition or released by the user to its initial deformable state. Subsequently, the grip can again be deformed by the same user or a different user to an alternative relatively nondeformable set configuration. This is accomplished by the use of a magnetorheological (MR) material, which is contained within the grip. By moving a permanent magnet in proximity to the magnetically responsive material or by selectively changing the strength of a proximate magnetic field, the deformability of the grip can be adjusted.

In a preferred form of the invention, the implement body or other equipment handle is configured to include a recessed annular cavity wherein a magnetorheological (MR) fluid is disposed within an annular, elastomeric tube. A permanent magnet assembly residing within the inside diameter of the elastomeric tube containing the (MR) fluid is arranged such that in an on-state of the present device, the magnetic flux field extends radially to pass through the (MR) fluid to solidify it in a nondeformable set configuration. In an off-state of the present device, the magnetic flux lines are shunted and the (MR) fluid returns to its deformable condition. A frictional selector mechanism is provided to hold the magnet assembly in the selected position during use.

In this manner the user may form a custom fit configuration by grasping the implement or tool with the fingers in the normal manner and selectively retain the customized grip in a relatively nondeformable set condition by manipulating the magnet assembly with a selector button. The customized grip contours will remain for as long as the magnetic field is maintained.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENTS

Figure 1:
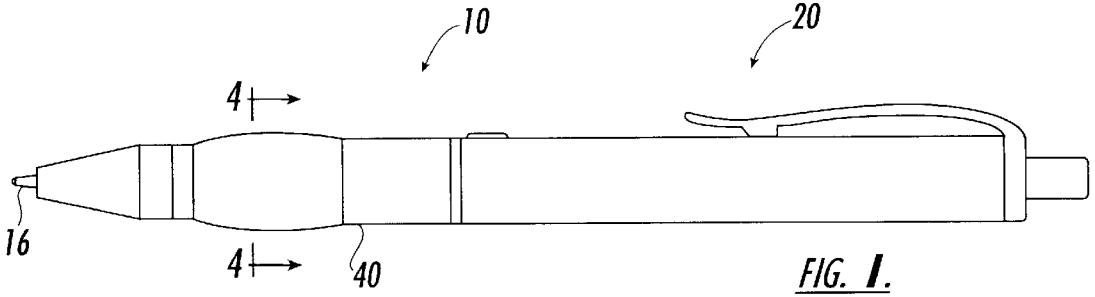
FIG. 1 is a side elevational view of a writing instrument whereon a magnetorheological grip in accordance with the present invention is disposed.

With further reference to the drawings, there is shown therein a writing implement, indicated generally at 20, whereon a magnetorheological (hereinafter "MR") grip in accordance with the present invention is disposed in its functional position, indicated generally at 10 and illustrated in FIG. 1. For purposes of this application the term "magnetorheological or (MR)" is defined as being descriptive of materials having physical properties of elasticity, viscosity, and plasticity, which can be selectively altered by exposing the material to a magnetic field of sufficient strength. The term "(MR) material" may designate any of the physical forms of the material such as an (MR) fluid, an (MR) gel, an (MR) grease, an (MR) elastomer, or magnetically permeable particles (i.e. an (MR) fluid wherein air is the carrier fluid).

Figure 2:
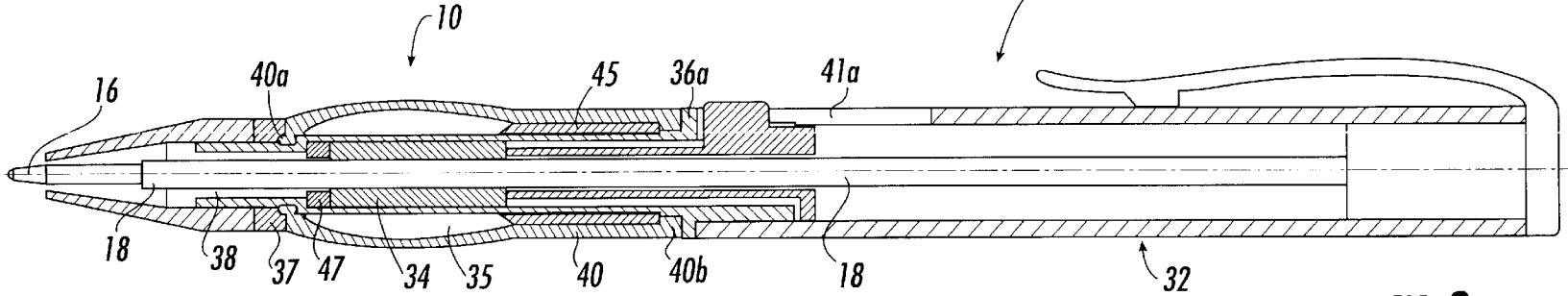
FIG. 2 is a longitudinal cross-section of the writing instrument of FIG. 1 showing the details of the construction thereof.

As more clearly shown in FIG. 2, the writing instrument or pen 20 includes an elongated, cylindrical body member, indicated generally at 32, which carries an ink cartridge 18 or other marking medium having a marking tip 16 that is extendable from one end of the body member 32. The present (MR) grip 10 is radially disposed about the body member 32 at the end adjacent to the projecting marking tip 16 for fingertip grasping when the pen 20 is used in the normal manner. The mechanism for extending and retracting the marking medium has been omitted for clarity.

Figure 3:
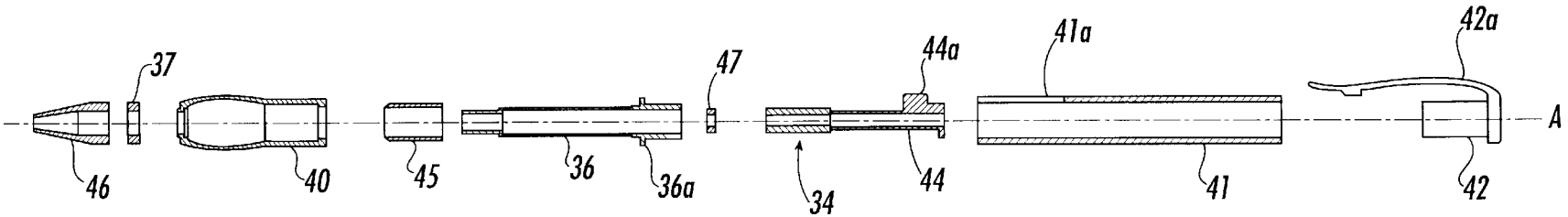
FIG. 3 is an exploded longitudinal cross-section of the writing instrument of FIG. 2 showing the component parts thereof.

The body member 32 is further comprised of a plurality of generally nonferrous component parts arranged in concentric relation about the longitudinal axis A, which are now described with reference to FIG. 3. A cylindrical aft barrel 41 having an interior bore is dimensioned to a slip fit condition with pen cap 42 to receive the cap 42 at one end thereof. Cap 42 includes a conventional clip 42*a* for securing the pen in place.

An opposite end of the barrel 41 has a longitudinal slot 41*a* formed along the midline thereof to accommodate the sliding movement of the permanent magnet assembly, indicated generally at 34. More specifically, the cylindrical magnet assembly 34 is coupled in concentric relation to the non-ferrous slider tube 44 including the integral slide button 44*a*, which slidingly engages the slot 41*a* in the aft barrel 41 when assembled.

The magnet assembly 34 is comprised of at least one permanent magnet and a pole piece (not shown), which generate the magnetic field and direct the field toward the (MR) material. The magnet assembly is constructed such that the magnetic lines of flux generated by the permanent magnets extend radially from the magnet assembly 34 so as to pass through the (MR) material contained in the grip 10 as explained hereinafter in further detail.

The magnet assembly 34 and the attached slider tube 44 have an outside diameter that is dimensioned to a sliding fit with the inside diameter of the forward barrel 36. In an assembly procedure, the forward barrel 36 and the aft barrel 41 are coupled being joined end-to-end such that the magnet assembly 34 and the attached slider tube 44 are permanently captured therebetween. The slide button 44*a* protrudes from the slot 41*a* to permit the user to selectively move the magnet assembly 34 axially forward in proximity to the (MR) material to adjust the deformability of the grip 10 as hereinafter described.

A ferrous ring 47 is installed within the forward barrel 36 at the distal end thereof to provide internal sealing of the cavity 35 after the completion of a filling procedure wherein the (MR) fluid is introduced into the cavity 35. In addition, the ferrous ring 47 provides a magnetic surface whereon the magnet assembly 34 may attach itself at the extent of its forward travel in the on-state position of the slide button 44*a* as shown in FIG. 2.

Still referring to FIG. 2, a cylindrical ferrous shield 45 having an inside diameter that is dimensioned to a slip fit condition with an outside diameter of the forward barrel 36 is installed thereon in a predetermined position. The shield 45 functions to divert the magnetic lines of flux generated by the magnet assembly 34 in an off-state position of the slide button 44*a* (i.e. when the slide button 44*a* is withdrawn in the aft direction within the slot 41*a* as in FIG. 6A).

Figure 4:
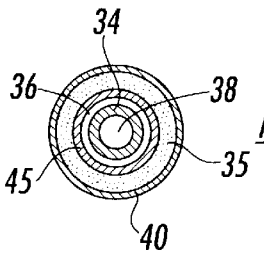
FIG. 4 is a sectional view taken along the section line 4—4 of FIG. 1 showing the concentric arrangement of the component parts.

In a preferred embodiment the pen 20 is configured to include a generally annular, recessed cavity 35 defined between axially-spaced annular shoulder 36*a* of the forward barrel 36 at one end and an annular crimp ring 37 at the other end as best shown in FIG. 2. The cavity 35 surrounds an elongated central bore 38 extending through the pen 20 and defined by the end-to-end alignment of the inside diameters of the forward and aft barrels 36 and 41, the magnet assembly 34, and the slider body 44 as shown in FIG. 4. The axial length of the recessed cavity 35 may vary in accordance with the size and particular type of writing pen 20 or other handheld implement with which the present (MR) grip 10 is to be utilized.

The recessed cavity 35 wherein the (MR) material resides is enclosed by a tubular sleeve 40 constructed from materials such as elastomer or polymer tubing, shrink tubing (ie. neoprene or soft polyolefin), or urethane film. The sleeve 40 is installed over the ferrous shield 45 and the forward barrel 36 as seen in FIG. 2 contacting the outside diameters of the forward barrel 36 at either end.

A magnetorheological (MR) material is contained within the cavity 35 beneath the sleeve 40 for accommodating finger pressure induced deformation of the sleeve 40 during use. Any number of magnetorheological (MR) materials such as an (MR) fluid, (MR) grease, an (MR) gel, an (MR) elastomer, or magnetically permeable particles (i.e. an (MR) fluid utilizing air as the carrier fluid) are suitable for this application.

In the alternative, an open-cell foam (not illustrated), annular pieces of elastomer material or other similar material saturated in (MR) fluid may be contained in the cavity 35. The optional open-cell foam or other material disposed within the cavity 35 functions to: (1) reduce the volume of (MR) material required to fill the cavity 35 thereby reducing cost and weight; (2) produce a softer feel to the grip 10; and (3) aid in the encapsulation and sealing of the (MR) material. In this alternative embodiment a shrink wrap tubing (not shown) may be preferable and be used in lieu of the elastomeric sleeve 40 to retain the layer of open-cell foam or similar materials saturated in (MR) fluid.

The cavity 35 containing the (MR) material is sealed at each end using conventional techniques. In the embodiment shown in FIG. 2, molded O-rings 40*a* and 40*b* are integrally formed with the tubular sleeve 40 to effect a leakproof seal. A crimp ring 37 is mechanically crimped about the molded O-rings as at 40*a* to facilitate sealing. Alternatively, separate O-rings or suitable adhesives (not illustrated) may be utilized to effect sealing of the sleeve 40.

A conical tip 46 having internal threads (not shown) formed on an inside diameter thereof engages a mating external thread (not shown) formed on a reduced diameter at the distal end of the forward barrel 36 to complete the assembly of the pen 20.

The writing instrument 20 may be provided with a mechanism (not illustrated) for extending and retracting the marking tip 16 of the ink cartridge 18. This mechanism may be of the conventional, compression spring type actuated by a so-called clicker button, which is common to inexpensive pens. Alternatively, the pen 20 may utilize a rotary mechanism wherein an upper body member is rotated about its longitudinal axis to alternately extend and retract the marking tip. Further, the marking tip extension mechanism to be employed may be mechanically integrated with the slide button 44*a*, (or switch 67 seen in FIG. 8) such that the marking tip 16 is extended simultaneously with the actuation of the (MR) grip 10 to provide a novel aspect to the pen 20.

Figure 5C:
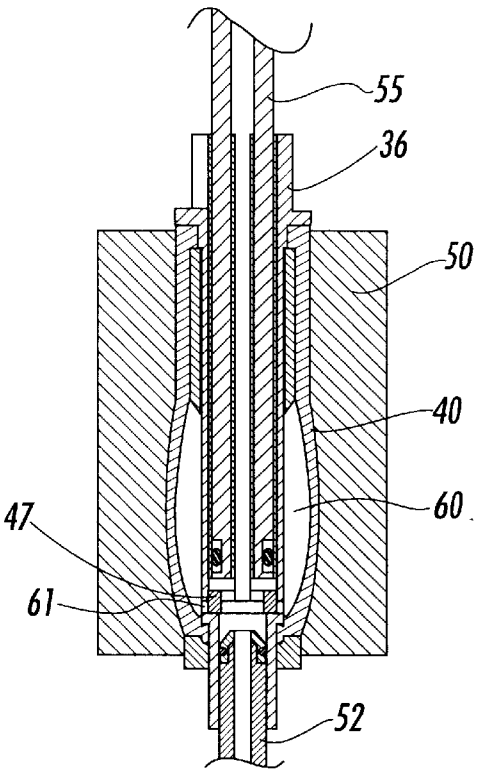
FIGS. 5A–5C depict sequentially an evacuation/filling procedure for introducing magnetorheological (MR) fluid into the writing instrument.
Figure 5B:
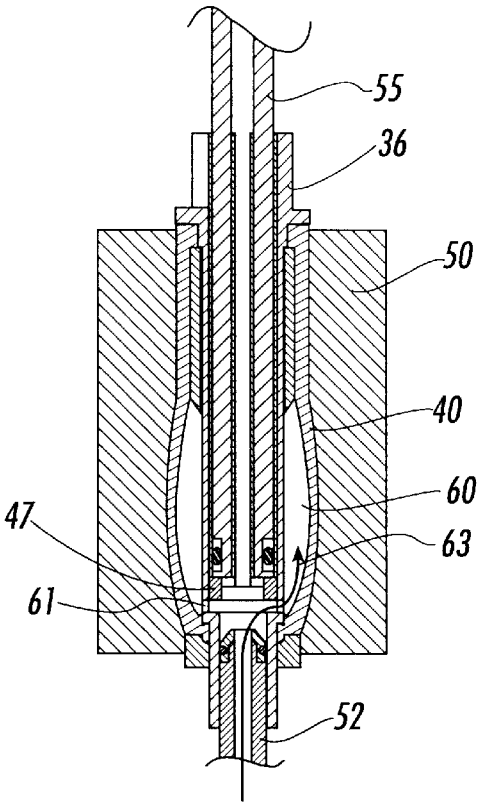
Figure 5A:
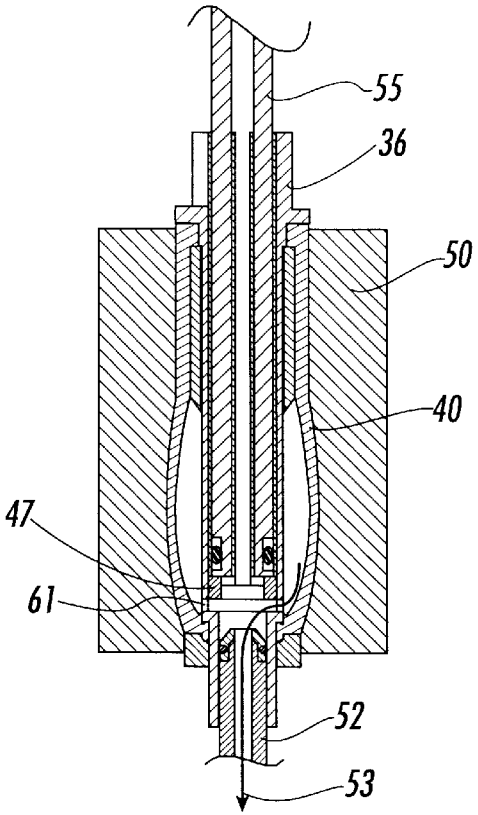

Referring now to FIGS. 5A–5C there is depicted therein sequentially an evacuation/ filling procedure for introducing an (MR) fluid into the cavity 35. In this procedure a subassembly of the pen 10 including the forward barrel 36, whereon the sleeve 40 has been installed and sealed in position by crimp ring 37, is secured in a tooling fixture 50 fabricated to fit the external contours of the subassembly.

Initially, a seal installation apparatus 55 with a ferrous seal ring 47 preloaded thereon is inserted into the proximal end of forward barrel 36 to the position shown in FIG. 5A providing an airtight seal therein. An evacuation/fill nozzle 52 is inserted into the opposite, distal end of the forward barrel 36 also producing an airtight seal. Next, the cavity 35 is evacuated by application of vacuum through the nozzle 52 prior to introducing the (MR) fluid as indicated by directional arrow 53.

Thereafter, a predetermined quantity of (MR) fluid 60 is delivered into the cavity 35 via fill holes 61 as indicated by directional arrow 63 in FIG. 5B. Next, the seal installation apparatus 55 is actuated to press fit the seal ring 47 against the inner end face of the barrel 36 in sealing relation to the fill holes 61 as shown in FIG. 5C to complete the filling procedure. The seal ring 47 may be secured by a suitable adhesive or by such manufacturing processes as ultrasonic welding to ensure a permanent seal.

Figure 6A:
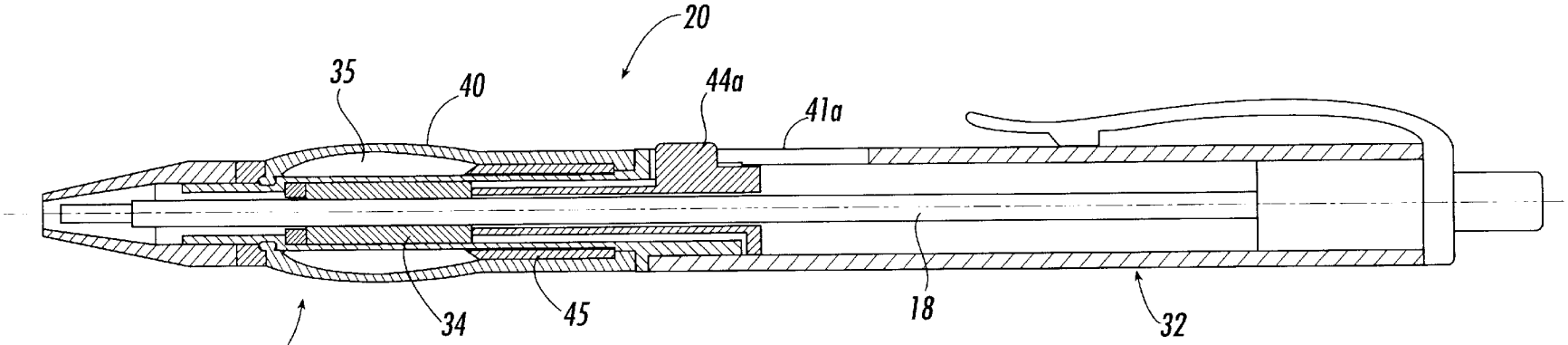
FIGS. 6A and 6B illustrate an off-state position and an on-state position respectively of a preferred embodiment the present grip.
Figure 6B:
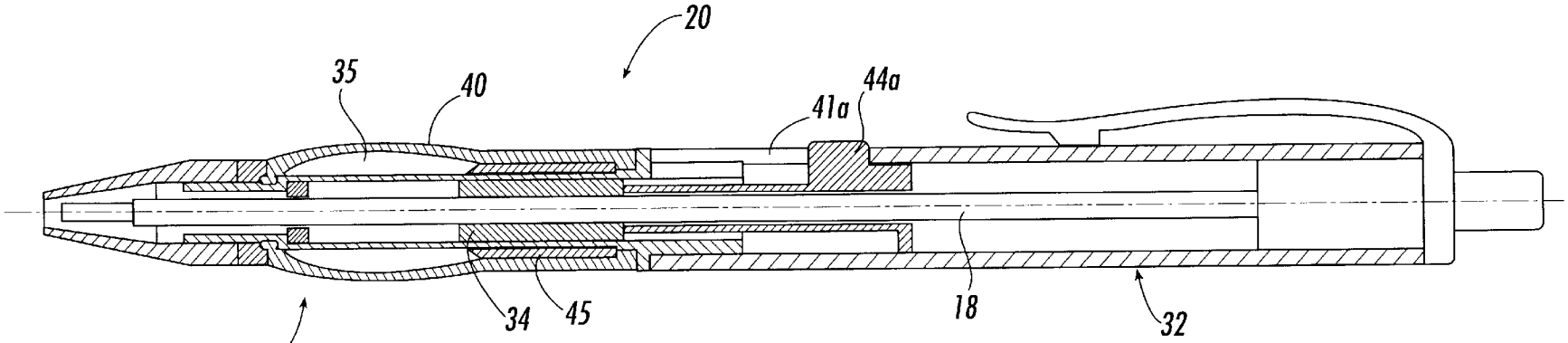

With reference to FIGS. 6A and 6B, the practical operation of the pen 20 to adjust the deformability of the grip 10 will now be described. In FIG. 6B the pen 20 is shown with the permanent magnet assembly 34 in the off-state position. That is, the slide button 44*a* is positioned at the aft end of the slot 41*a*. It will be noted that in the off-state position the magnet assembly 34 is disposed within and directly beneath the ferrous shield 45. The shield 45 functions to divert or shunt the radially extending magnetic lines of flux generated by the magnet assembly 34 thereby preventing any effect on the (MR) fluid material within the grip 10. Thus, in the off-state position shown in FIG. 6B, the (MR) fluid remains in a soft, pliable condition capable of being deformed in conformance with the hand and finger pressure of the user.

In FIG. 6A the pen 20 is shown with the magnet assembly 34 in the on-state position. That is, the slide button 44*a* is advance to the forward end of the slot 41*a*. It will be noted that in the on-state position, the magnet assembly 34 is shifted forwardly and out of the ferrous shield 45 to a position within the (MR) fluid-filled sleeve 40. In this position the radially extending flux lines generated by the magnet assembly 34 pass directly through the (MR) fluid within the sleeve 40 causing it to solidify instantaneously. Thus, in the on-state position the (MR) fluid within the grip 10 assumes a configuration in conformance with anatomical contours of the user. This relatively nondeformable set condition of the grip 10 remains indefinitely for as long as the magnetic field is maintained. As used herein, "relatively nondeformable set condition" means that in the set condition or on-state position the grip is less deformable than in the off-state condition. However, under certain increased force applied by the user the grip could partially or slightly deform in the set condition. Upon the return movement of the slide button 44*a* to the off-state position shown in FIG. 6B, the magnetic flux field is again shielded and the (MR) fluid reverts to its deformable condition.

Figure 7:
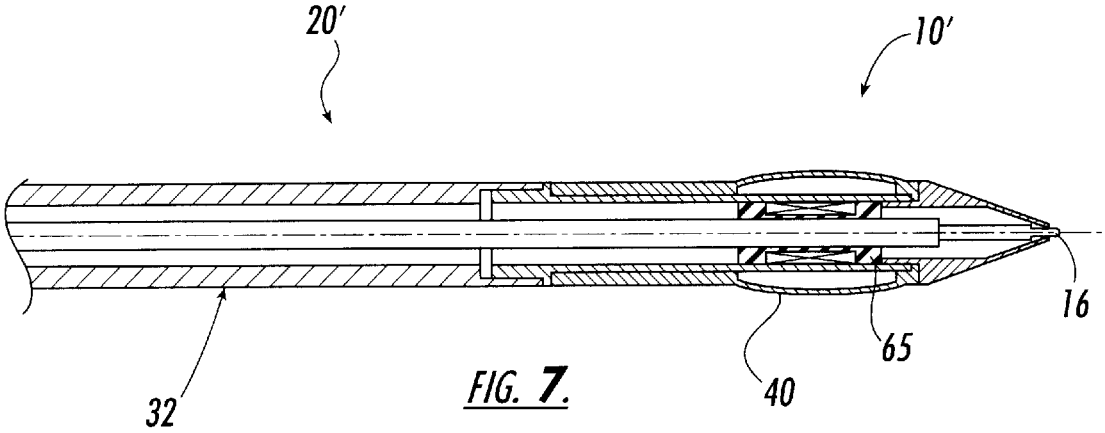
FIG. 7 is a longitudinal cross-section of an alternative embodiment of a writing instrument in accordance with the present invention including an electromagnet assembly.
Figure 8:
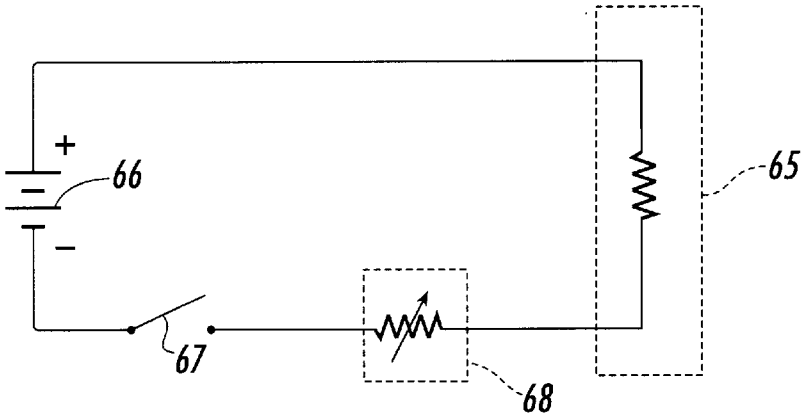
FIG. 8 is an electrical schematic diagram showing the circuitry and components of the alternative embodiment of FIG. 7.

FIGS. 7 and 8 illustrate an alternative embodiment of the present (MR) grip 10' for a writing instrument 20' wherein an electromagnet 65 including a coil and pole pieces is utilized to apply an electromagnetic field to the (MR) fluid contained within the sleeve 40. The electromagnet 65 is electrically connected by circuitry to a miniature battery 66 located within the pen 20'. Such electrical connection is made through a switch 67 and/or varistor 68, which permits adjustment of the voltage applied to the electromagnet 65. The switch 67 may be integrated with any marking tip extension mechanism employed with the pen 20' such that the (MR) grip 10' is actuated simultaneously with the extension of the marking tip 16.

Alternatively, it will be understood that the depiction of a writing instrument 20 is for illustrative purposes only and that the present (MR) grips 10 and 10' may be applied to any number of different types of pens, pencils, and other types of writing implements, as well as to other manual implements. For example, it is contemplated that the present (MR) grips 10 and 10' in various embodiments are adaptable to use with hand tools, shaving instruments, medical instruments, and sports equipment such as golf clubs, tennis rackets, fishing poles, and baseball bats to list only a few potential applications for handheld devices.

Further, it will be appreciated by those skilled in the art that the physical size, shape, and cross-sectional geometry of the present (MR) grips 10 and 10' can be varied significantly without departing from the scope of the invention. For example, the tubular (MR) grip 10 may be modified to provide an (MR) pad (not illustrated) to conform with the anatomical contours of various other body parts such as to the feet and knees to construct custom fit surfboards, kneeboards, etc. Further, such (MR) pads could be varied in size and geometry to function as personalized pads for eyeglasses or hearing aids and various other devices.

Moreover, although illustrative embodiments of the invention have been described, a latitude of modification, change, and substitution is intended in the foregoing disclosure, and in certain instances some of the features of the invention will be employed without a corresponding use of other features. For example, it will be appreciated by those skilled in the art that in yet another construction (not shown), the ferrous shield or shunt 45 may be shifted axially relative to a fixed permanent magnet assembly 34 to provide the alternating on and off states of the present (MR) grip 10.

Although not specifically illustrated in the drawings, it should be understood that additional equipment and structural components will be provided as necessary, and that all of the components described above are arranged and supported in an appropriate fashion to form a complete and operative system incorporating features of the present invention.

What is claimed is:

1. A deformable grip comprising:

a material retainer forming a cavity;

a magnetically responsive material disposed in the cavity;

a magnetic field generator producing a magnetic field which acts on the magnetically responsive material;

a selector which selectively changes the magnetic field to adjust grip deformability by moving the magnetic field generator to the position relative to the magnetically responsive material required to produce the desired degree of deformability of the magnetically responsive material; and a ferrous shield disposed in the material retainer cavity, the shield adapted to receive the magnetic field generator within the ferrous shield when a highly deformable grip is desired, the shield serving to divert lines of flux away from the magnetically responsive material.

2. An apparatus including the deformable grip of claim 1 further comprising a body whereon said grip is mounted.

3. The deformable grip of claim 1 wherein said material container comprises a deformable member.

4. The deformable grip of claim 3 wherein said deformable member comprises an elastomeric sleeve.

5. The deformable grip of claim 1 wherein said cavity is formed between a body and a deformable member.

6. The deformable grip of claim 1 wherein said magnetically responsive material comprises a magnetorheological fluid.

7. The deformable grip of claim 1 wherein said field generator comprises at least one permanent magnet.

8. The deformable grip of claim 7 wherein said at least one magnet comprises an annular shape.

9. The deformable grip of claim 7 wherein said selector comprises a slide mechanism for moving said field generator relative to said material.

10. The deformable grip as claimed in claim 1, wherein the selector is selectively moveable between a first on-state position and a second off-state position, the deformable glip being less deformable when the selector is in the on-state position.

11. The deformable grip as claimed in claim 1, wherein the magnetic field generator is located behind the shield when in the off-state position to divert the magnetic field generated by the magnetic assembly when the magnetic field generator is in the off-state position.

12. The deformable grip as claimed in claim 1, wherein the selector is comprised of a slider tube having a first end, and a second end, wherein the magnetic field generator is a magnet assembly being located at the slider tube first end, a slide button being located proximate the second slider tube end; the selector being selectively moveable between a first on-state position where the magnetic field generator is located adjacent the cavity, and a second off-state position, where the magnetic field generator is located away from the cavity, the deformable grip being less deformable when the selector is in the on-state position.

13. The deformable grip as claimed in claim 1 wherein the magnet assembly is located within the shield when in the off-state position to divert a magnetic field generated by the magnet assembly when the magnetic field generator is in the off-state position.

14. A deformable grip comprising:

a material retainer forming a cavity;

a magnetically responsive material disposed in the cavity;

a magnetic field generator producing a magnetic field which acts on the magnetically responsive material;

a selector which selectively changes the magnetic field to adjust grip deformability, the selector being moveable between a first on-state position and a second off-state position, the magnetically responsive material being less deformable when the selector is in the on-state position than when the selector is in the off-state position; and a ferrous shield, the magnetic field assembly being located within the shield when the selector is in the off-state position to divert lines of flux away from the magnetically responsive material.

15. The deformable grip as claimed in claim 14 wherein the ferrous shield is fixedly located in the cavity.

16. The deformable grip as claimed in claim 14 further comprising a ferrous ring whereon the magnetic field generator may attach itself at the extent of movement to the on-state position.

17. A deformable grip comprising:

a. a first tubular member;

b. a second tubular member movable through the first tubular member;

c. a material retainer, the material retainer being located substantially outwardly of the first and second tube members;

d. a shield member located between the material retainer and the first tubular member, the shield member, the first tubular member and the material retainer defining a cavity;

e. a magnetically responsive material disposed in the cavity; and f. a magnetic field generator producing a magnetic field which acts on the magnetically responsive material, the magnetic field generator located at one end of the second tubular member, the magnetic field generator being movable with the second tubular member between a first on-state position where the magnetic field generator is located adjacent the magnetically responsive material to decrease the degree of grip deformability, and a second off-state position where the magnetic field generator is located within the shield member to divert magnetic flux lines away from the magnetically responsive material and increase the degree of grip deformability.

18. The deformable grip as claimed in claim 17 further comprising a ferrous ring at one end of the deformable grip, whereon the magnetic field generator may attach itself at the extent of movement to the on-state position.

19. The deformable grip as claimed in claim 17 wherein the material retainer includes sealing means for sealing the cavity, and wherein the sealing means is made integral with the first and second tubular members.

20. The deformable grip as claimed in claim 17 wherein the shield member is ferrous.

21. The deformable grip as claimed in claim 17 wherein the magnetically responsive material is magnetorheological fluid.

22. The deformable grip as claimed in claim 17 wherein the grip is used in combination with a writing implement.

* * * * *